US005296187A

United States Patent [19]

Hackman

[11] Patent Number: 5,296,187

[45] Date of Patent: Mar. 22, 1994

[54] METHODS FOR MANUFACTURING COLUMNAR STRUCTURES

[75] Inventor: Lloyd E. Hackman, Worthington, Ohio

[73] Assignee: Ribbon Technology, Corp., Gahanna, Ohio

[21] Appl. No.: 35,947

[22] Filed: Mar. 23, 1993

[51] Int. Cl.[5] ..... B28B 1/00

[52] U.S. Cl. ..... 264/257; 264/267; 264/269; 264/273; 264/275; 264/279; 264/279.1; 264/333; 264/334

[58] Field of Search ..... 264/510, 571, 102, 311, 264/310, 257, 258, 333, 86, 87, 255, 256, 328.2, 279, 279.1, 273, 277, 267, 32, 36, 269, 275, 334

[56] References Cited

U.S. PATENT DOCUMENTS

| | | | |
|---|---|---|---|
| 1,111,909 | 9/1914 | Kramer | 264/267 |
| 1,496,819 | 6/1924 | Mitchell | 264/267 |
| 2,358,758 | 9/1944 | Eames | 264/257 X |
| 2,453,223 | 11/1948 | Henderson | 264/257 |
| 2,673,373 | 3/1954 | Heuer | 264/267 X |
| 2,677,955 | 5/1954 | Constantinesco | 70/50 |
| 2,830,352 | 4/1958 | Gibson | 249/137 |
| 3,100,677 | 8/1963 | Frank et al. | 264/267 X |
| 3,429,094 | 2/1969 | Romualdi | 52/659 |
| 3,479,704 | 11/1969 | Reed | 264/267 X |
| 3,726,950 | 4/1973 | Turzillo | 264/256 X |
| 3,780,975 | 12/1973 | Turzillo | 249/134 X |
| 3,808,085 | 4/1974 | Givens | 161/59 |
| 3,986,885 | 10/1976 | Lankard | 106/99 |
| 4,021,258 | 5/1977 | Uagaeshi . | |
| 4,132,577 | 1/1979 | Wintermantel | 264/257 X |
| 4,159,361 | 6/1979 | Schupack | 428/240 |
| 4,209,338 | 6/1980 | Magnus | 106/99 |
| 4,235,831 | 11/1980 | Larive | 264/333 X |
| 4,242,406 | 12/1980 | El Bouhnini et al. | 428/236 |
| 4,344,804 | 8/1982 | Bijen et al. | 156/42 |
| 4,365,255 | 12/1982 | Lankard | 501/95 |
| 4,366,255 | 12/1982 | Lankard . | |
| 4,373,981 | 2/1983 | Bömers et al. | 156/164 |
| 4,513,040 | 4/1985 | Lankard | 428/49 |
| 4,559,881 | 12/1985 | Lankard et al. | 109/83 |
| 4,593,627 | 6/1986 | Lankard et al. | 109/83 |
| 4,594,206 | 6/1986 | Grafton | 264/86 |
| 4,600,459 | 7/1986 | Proctor | 264/267 X |
| 4,617,219 | 10/1986 | Schupack . | |
| 4,687,614 | 8/1987 | Suzuki et al. | 264/102 X |
| 4,778,718 | 10/1988 | Nicholls | 428/287 |
| 4,810,569 | 3/1989 | Lehnert et al. | 428/285 |
| 4,916,004 | 4/1990 | Ensminger et al. | 428/192 |
| 4,930,565 | 6/1990 | Hackman et al. . | |
| 4,996,019 | 2/1991 | Catalayoud et al. . | |
| 5,209,603 | 5/1993 | Morgan . | |
| 5,209,968 | 5/1993 | Sweeney . | |

FOREIGN PATENT DOCUMENTS

| | | | |
|---|---|---|---|
| 2359170 | 6/1975 | Fed. Rep. of Germany | 264/257 |
| 52-36542 | 9/1977 | Japan | 264/267 |
| 0061261 | 3/1990 | Japan | 264/267 |
| 2062048 | 5/1981 | United Kingdom | 264/267 |

*Primary Examiner*—Karen Aftergut
*Attorney, Agent, or Firm*—Thompson, Hine and Flory

[57] ABSTRACT

A method for manufacturing a reinforced cementitious columnar structure including: providing a mold having a cavity which corresponds to a shape and size of the columnar structure; placing at least one nonwoven metal fiber mat around the periphery of the cavity; filling the cavity with a slurry of cementitious material containing aggregate having a particle size greater than the size of the interstitial voids of the fiber mat; curing the slurry of cementitious material; and removing the mold.

6 Claims, 5 Drawing Sheets

METHODS FOR MANUFACTURING COLUMNAR STRUCTURES

BACKGROUND OF THE INVENTION

The present invention relates to methods for manufacturing columns and for reinforcing members in a metal fiber reinforced concrete sleeve. In one embodiment, the latter method may be used for repairing support members such as beams, struts, braces, etc., which have become fractured, cracked or otherwise weakened over a period of time. In another embodiment it may be used to secure vessels used to store hazardous waste.

Metal fiber reinforced cementitious composites have been described in U.S. Pat. No. 3,429,094 to Romualdi, U.S. Pat. Nos. 3,986,885, 4,366,255 and 4,513,040 to Lankard, U.S. Pat. No. 4,617,219 to Schupak, U.S. Pat. No. 2,677,955 to Constantinesco, and commonly assigned copending U.S. patent application Ser. No. 07/851,647, filed Mar. 16, 1992. U.S. Pat. No. 4,996,019 relates to a container for the storage of nuclear waste made from a concrete reinforced by metal fibers.

Concrete columns are commonly used as an upright support for superstructures such as highway overpasses, bridges and the like. These columns are typically constructed by filling a cylindrical form having a network of rebar mounted therein with a concrete composition, allowing the composition to cure, and removing the form.

Concrete support members such as beams, girders, struts, braces, etc. are employed to impart strength and stability to a large variety of structures. Over long periods of time, these support members are subjected to heavy loads, vibrations, pressures and stresses which cause the members to weaken and fracture or crack. It has been a general practice to replace these weakened supports with new members, particularly in areas where replacement is easily accomplished. In large structures such as buildings, bridges, highway ramps, etc., which use steel reinforced concrete as support members, the replacement of these members can be very time consuming and expensive. In view of modern day advancements in materials, attention is now being given to the repair of such support members rather than replacement.

SUMMARY OF THE INVENTION

In copending and commonly assigned U.S. application Ser. No. 07/851,647 concrete metal fiber mat reinforced composites are described. It has now been found that these composites are useful in a number of applications in which their strength properties provide unique advantages. It has been found that a highly reinforcing sleeve can be fabricated by infiltrating a metal fiber mat with a cementitious composition. The sleeve may be cast as part of a columnar structure or it may be formed on a pre-existing structure to conveniently effect a repair as described herein. It has also been found useful to encapsulate and thereby secure a container of hazardous waste material.

It is an object of this invention to provide a method for manufacturing a concrete columnar structure having a circular or rectangular cross section reinforced at the periphery with a metal fiber mat wherein the core of the column may contain large concrete aggregate and the mat is infiltrated with a cementitious slurry containing no aggregate or very fine aggregate.

It is another object of this invention to provide a method for repairing concrete support beams, braces and other supporting structures which have been weakened, for example, by cracks, fractures, etc. The beams, braces, and supporting structures repaired in accordance with this invention may exhibit strength and stability which is at least equal to that of the original structure and, in many instances, may be measurably stronger.

It is yet another object of this invention to provide a method for securing vessels such as 55-gallon drums used to store hazardous waste to prevent leakage of such waste into the soil and water sources by encapsulating the drum in a metal fiber reinforced concrete member.

DEFINITION

The term "non-woven" as used herein with respect to the metal fiber mat means that the fiber forming the mat is not systematically woven. The mat is held together by random entanglement of the fibers. Typically the fibers are air-laid and compressed to form a mat of controlled density.

DETAILED DESCRIPTION OF THE INVENTION

In a first embodiment of this invention, a novel method for manufacturing a metal fiber mat reinforced cementitious column having a core of large aggregate and a metal fiber mat reinforced shell is described. This embodiment of the invention is illustrated by FIGS. 1 and 2.

Figure 1:
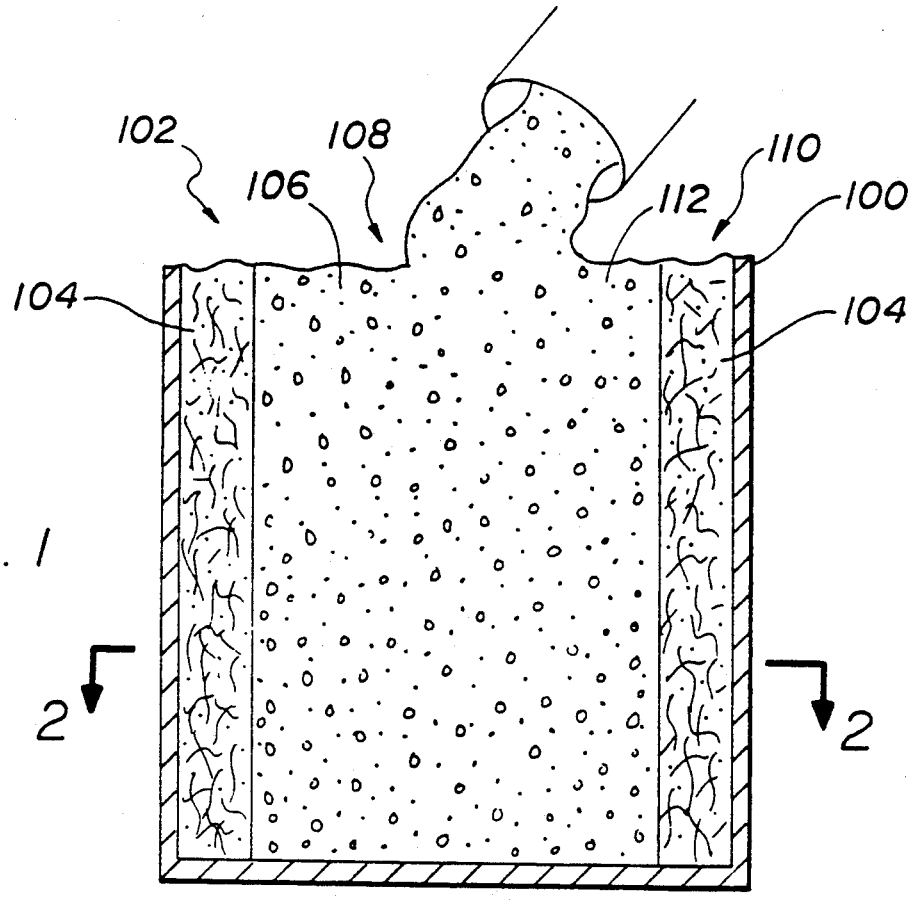
FIG. 1 is a sectional elevational view of a molding apparatus for forming a metal fiber reinforced structure in the form of a column.
Figure 2:
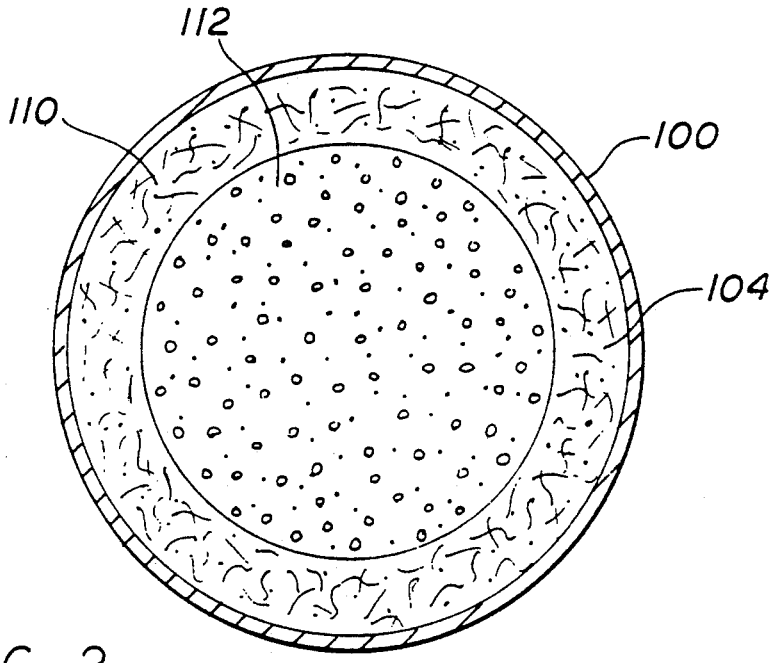
FIG. 2 is a cross-sectional view of the column of FIG. 1 along line 2—2'.

FIG. 1 is a sectional view of a solid, metal-reinforced column manufactured in accordance with the invention. FIG. 2 is a cross-sectional view of the column along lines 2—2'. As illustrated in FIGS. 1 and 2, a mold 100 has a cavity which conforms in shape and size to the desired column 102. In a first manifestation of this embodiment, the reinforced shell 110 of the column 102 is cast in place. A metal fiber reinforcing mat 104 is placed into the mold cavity in an annular fashion and a slurry of cementitious material 106 is poured into the center of the mold cavity, i.e., into the core volume 108. Preferably, the metal fibers forming the mat are randomly oriented at the circumference of the column.

The cementitious material 106 spreads radially to completely fill the mold cavity and infiltrates the metal fiber mat 104. Preferably, to provide additional strength to the column, the cementitious material 106 contains a conventional large aggregate 112, i.e., aggregate having a particle size greater than the interstitial voids of the metal fiber mat. The cementitious material 106 preferably contains a predetermined amount of aggregate 112 as described later. The fibrous mat 104 screens the large aggregate 112 from the cementitious slurry so that the large aggregate 112 is retained entirely in the core volume 108. Meanwhile, the slurry of cementitious material 106 containing no aggregate or aggregate having a particle size less than the interstitial voids of the fibrous mat 104 penetrates through the mat encapsulating the fibers and filling the interstitial voids of the fiber mat 104 forming the reinforced shell 110.

Alternatively, the mat 104 can be placed in the mold 100 in an annular orientation and the core can be filled with a dry aggregate. A cement slurry which is aggregate-free or which contains a fine aggregate sand is poured into the mold cavity. The slurry infiltrates both the mat 104 and the large aggregate 112 in the core.

In a column in which a specific percentage of aggregate is desired in the core, the ratio of the amount of aggregate in the slurry to the amount of aggregate desired in the core is equal to the ratio of the volume of the core to the total volume of the cavity, consideration being given to the volume occupied by the metal fibers. This can be expressed by the equations $C=100\times Vc/Vt$ and $S=100-C$ where S is the percent of the slurry, C is the percent of standard aggregate concrete desired in the core, Vc is the core volume and Vt is the total volume of concrete in the column.

When desired, the core may be additionally reinforced by rebar or wire mesh where higher strength is required. Conventional rebar or wire mesh reinforcements may be used for this purpose.

Figure 3:
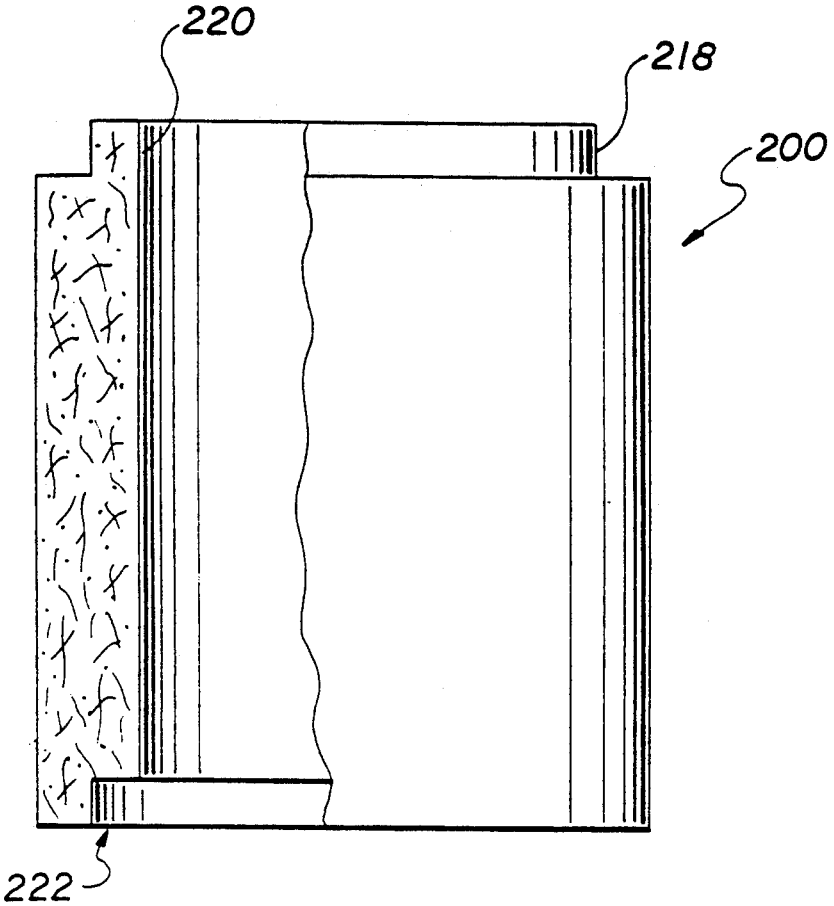
FIG. 3 is a sectional view of a pre-cast shell segment of a column in accordance with the invention.
Figure 4:
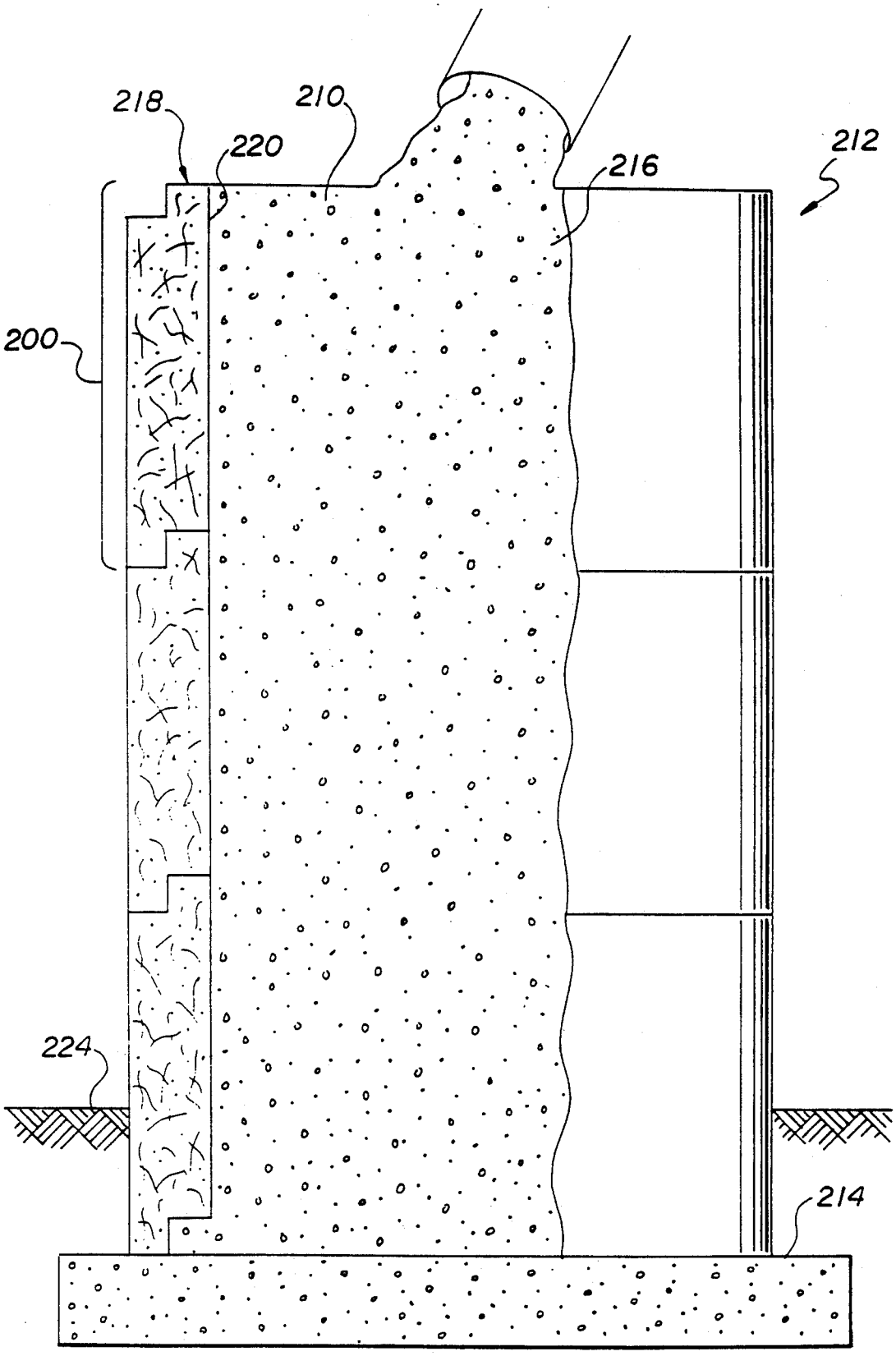
FIG. 4 is a sectional view of multiple pre-cast shell segments stacked one upon the other to form a column in accordance with the invention.

FIG. 3 illustrates another manifestation of this embodiment, wherein the metal fiber reinforced shell is precast as an individual fiber reinforced section 200 of predetermined dimensions and configuration, and the core may be formed within the shell at the job site. Generally, the segments are designed in a cylindrical shape. The shell becomes a set-in-place concrete form which can be transported to the job site in sections, assembled or stacked to form the column and filled with concrete to form the core. The shell may be formed with interfitting means or stacking features which provides a locking means whereby the sections are secured in a position one on top of the other. The locking means may be in the form of pins protruding from the top or bottom of one section for engagement into corresponding recesses in the bottom or top of another section. In FIGS. 3 and 4, the locking means are illustrated as a circumferential lip 218 protruding from the top of the shell. The lip has an outer circumference less than the outer circumference of the shell segment and the inner circumference of the lip 218 and the inner circumference of the shell segment 200 are equidistant from the center of the core and define the inner shell wall 220. The corresponding locking means at the bottom of the shell is defined as a circumferential recess 222 having dimensions suitable for engaging the corresponding lip 218 of another shell segment. While FIGS. 3 and 4 illustrate the lip 218 at the top of the shell section 200 and the recess 222 at the bottom of the shell section 200, it is within the scope of the invention to invert the shell sections such that the lip 218 is at the bottom of the shell section where it engages the recess 222 at the top of another shell section. As stated above, the shells can be transported from the place of manufacture to the job site where they can be assembled one on top of the other as illustrated in FIG. 4. The shell members forming the base of the column may be placed on a supporting concrete slab 214, set directly in contact with the ground 224 or tied into a footer in a manner otherwise known in the art. If desired, the core may be reinforced in a conventional manner such as with rebar.

To form the shell member, a nonwoven mat may be placed in a ring mold and infiltrated with a cementitious slurry where it is allowed to set up to form a shell segment 200 which is then removed from the mold and transferred along with other shell segments to a location where segments are assembled and filled with cementitious material 210 containing aggregate 216 to form a column 212. As stated above, the shell segments may be of any dimension or shape which is effective for providing the desired structure.

Columns and support members reinforced with a metal fiber mat in accordance with the invention are advantageous because they retain substantial compression strength even in the event of a catastrophic failure such as may be caused by an earthquake. Forces such as this may cause the column to break down internally, but the fiber mat reinforced shell effectively contains any rock and rubble which may form internally of the column. In this manner, the shell maintains the column's compression strength and limits the extent of damage to the column.

Figure 5:
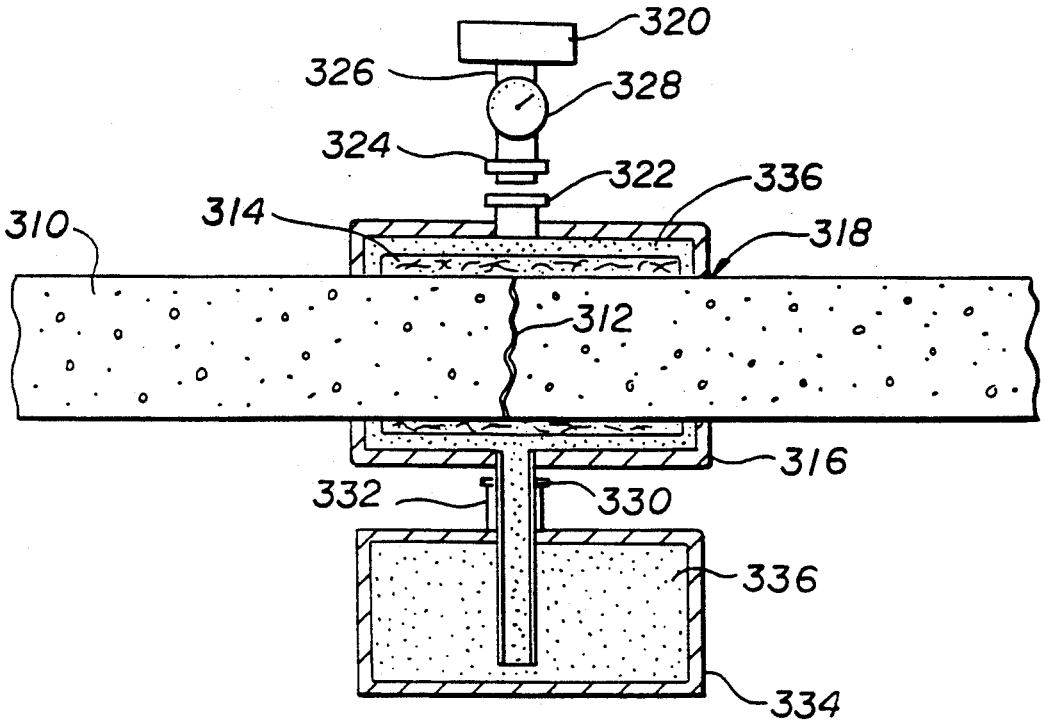
FIG. 5 is a sectional elevation of a fractured beam repaired in accordance with the invention.
Figure 6:
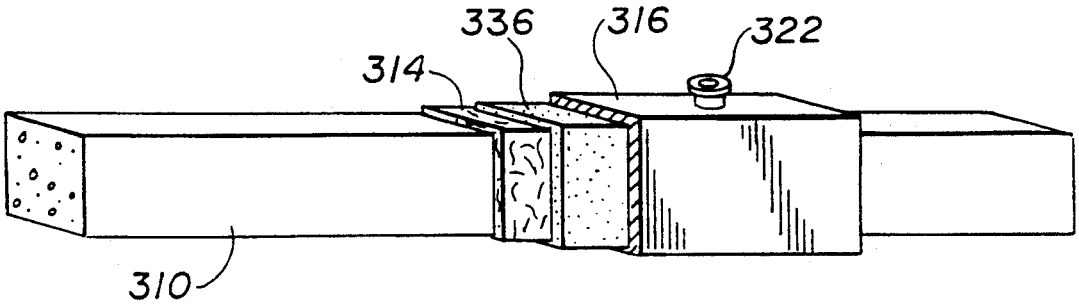
FIG. 6 is a perspective view of a repaired beam in accordance with the present invention.

In a second embodiment of this invention, a novel method for repairing large structural concrete support members such as beams, struts, braces, girders, etc. is provided. The embodiment is further illustrated in FIGS. 5 and 6. FIG. 5 is a sectional view of a fractured beam repaired in accordance with the invention. FIG. 6 is a perspective view of the repaired beam showing a cut-a-way view of the various layers. As shown in FIG. 5, beam 310 has a fracture 312 perpendicular to the length of the beam. In accordance with the invention the beam 310 is stabilized to prevent movement and a metal fibrous mat 314 is wrapped tightly around the beam 310 so that the fiber mat 314 sufficiently covers the fracture 312. The mat is preferably oriented such that the fibers run predominantly perpendicular to the plane of the fracture 312 or parallel the length of the beam 310.

A molding means 316 is placed around mat reinforced section of the beam 310. The molding means 316 may be formed of any suitable material, but a heavy duty rubber or plastic bag or sheet, which is sufficiently air-impermeable for the purpose described herein, is particularly useful. The molding means 316 is secured at its peripheral edges 318 so as to form an air tight seal between the mold 316 and the beam 310. A conventional vacuum bag sealant may be used to seal the peripheral edges 318 of the molding means 316. The molding means 316 includes a female coupling means 322 and a male coupling means 324.

In accordance with one manifestation of this embodiment, the repair is made by applying a vacuum to the mold 316 through coupling means 322 and 324 via conduit 326 and valve 328 using a pump 320. As the pump 320 draws air from the mold 316, a slurry of cementitious material 336 is drawn into the mold from a reservoir 334 via the conduit 332 connected to the mold through coupling means 330 and the cementitious material 336 infiltrates the mat material 314. The cementitious material 336 is allowed to cure to a sufficiently hardened state to permit removal of the mold 316. Additional drying and curing may be necessary to provide a repaired beam having strength and stability which is at least equal to that of the original beam.

In another manifestation of this embodiment, the concrete slurry may be pumped into the molding means using a positive displacement pump instead of a vacuum pump. In this embodiment, as the cementitious slurry is pumped into the mold cavity, it drives air from the cavity through an appropriate exhaust nozzle provided for the purpose.

Figure 7:
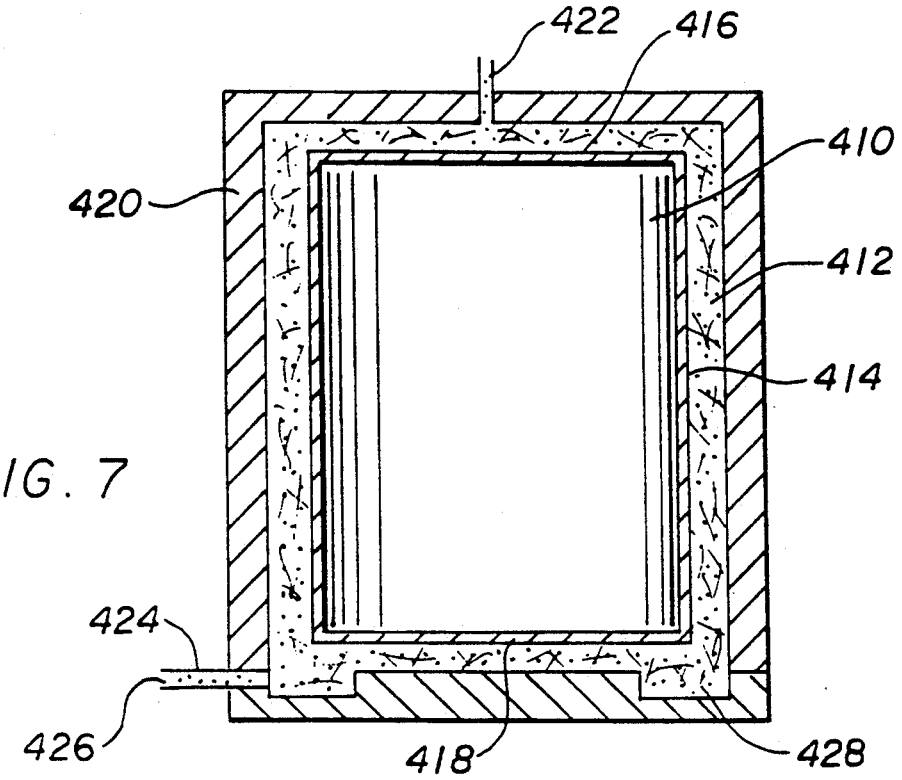
FIG. 7 is a sectional elevational view of a hazardous waste storage vessel encapsulated in accordance with the invention.

In a third embodiment of this invention, a method for encapsulating a storage vessel such as a 55-gallon drum containing hazardous waste material is provided. The waste may be a chemical waste or a nuclear waste, for example. The embodiment is further illustrated in FIGS. 7–8. As shown in FIG. 7, vessel 410 is completely wrapped with a nonwoven metal fiber mat 412 around the circumferential surface 414 of the vessel, the top 416 and bottom 418 of the vessel. The vessel 410 is encased in a molding means 420. The molding means 420 as defined above may be formed of any suitable material. The molding means 420 includes a first nozzle 422 and a second nozzle 424.

In accordance with a one manifestation of this embodiment, the infiltration of the permeable metal fiber mat 412 and the encapsulation of the storage vessel 410 is accomplished by applying a vacuum to the mold 420 through nozzle 422 using a vacuum pump (not shown). As the vacuum pump draws air from the mold 420, a slurry of cementitious material 426 is drawn into the mold 420 from a reservoir (not shown) through nozzle 424.

In another manifestation of this embodiment, the slurry of cementitious material 426 may be pumped into the molding means 420 using a positive displacement pump (not shown) instead of a vacuum pump. In this manifestation, as the cementitious material 426 is pumped into the molding means 420, it drives air from the molding means through nozzle 422 which operates as an exhaust nozzle.

Figure 8:
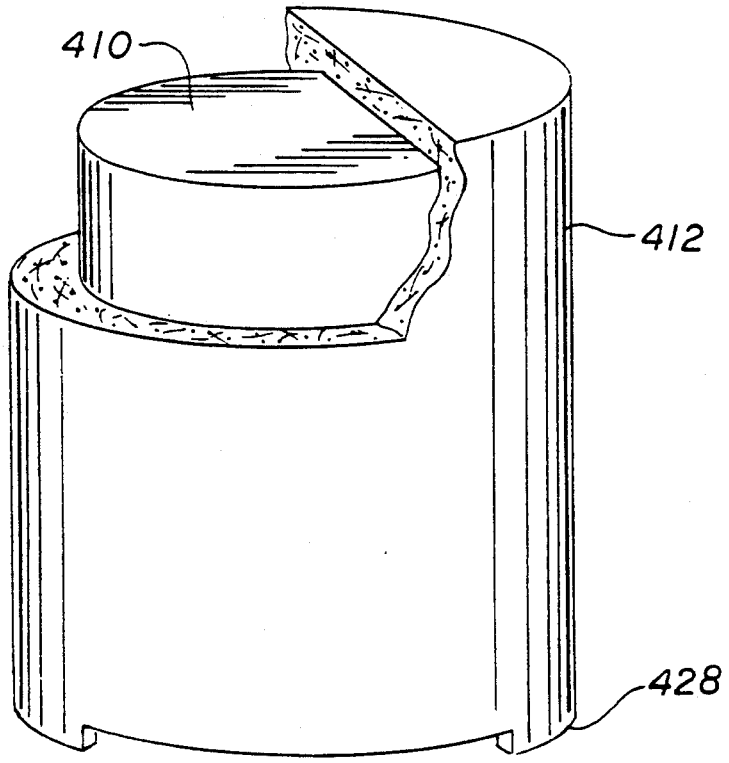
FIG. 8 is a perspective view of the encapsulated vessel of FIG. 7 in a cut-away view exposing a portion of the encapsulated vessel.

FIG. 8 illustrates the encapsulated storage vessel of this invention showing cementitious infiltrated metal fiber mat 412 surrounding the lower portion of vessel 410 while the upper portion of the structure is a cutaway view showing the storage vessel 410. According to FIGS. 7 and 8, the bottom of the encapsulated vessel 412 has optional support legs 428 on each side of the encapsulated vessel so as to permit handling of the encapsulated vessel by a lifting apparatus such as a fork lift truck.

The fiber reinforcing mat used in the present invention is prepared from metal fibers. Typically, the reinforcing element is a non-woven mat prepared from metal fibers such as stainless steel, carbon steel or manganese steel. Such mats are commercially available from Ribtec, Ribbon Technology Corporation, Gahanna, Ohio under the tradename MmatTEC or they may be prepared by the methods and apparatus described in U.S. Pat. Nos. 4,813,472 and 4,930,565 to Ribbon Technology Corporation. These patents disclose the production of metal filamentary materials ranging from a size less than one inch up to semicontinuous fibers.

The fibers are preferably about 4 to 12 inches long and more preferably about 9 inches long and have an effective diameter of about 0.002 to 0.060 inch and, preferably, about 0.010 to 0.025 inch. According to the method described in the patents, the fibers are forcibly blown into a chute where they are air laid on a conveyor and compressed into a mat. By controlling the speed of the conveyor and the extent of compression of the mat, the density of the mat can be controlled to produce mats in the range of 1.5 to 10.0% by volume density. In order to incorporate more than about 10% fiber into a composite, the mat must be compressed to an extent that it cannot readily be infiltrated with a cementitious mixture. Typical composites in accordance with the invention are prepared from mats which contain about 2 to 6% by volume fiber.

Any cementitious composition which will infiltrate the fiber mat may be used in the present invention including concrete, mortar and hydraulic and polymer cements. Representative examples of useful cements include Portland cement, calcium aluminate cement, magnesium phosphate cement, and other inorganic cements. The cementitious material must have a consistency which will allow it to easily penetrate and encapsulate the metal fibers. Preferably, it is a free flowing liquid. As noted previously, in forming columnar members, the concrete contains a large aggregate which is screened from the composition as it infiltrates the mat.

A superplasticizing agent may be added to the slurry of the cementitious material to better enable it to infiltrate the fibers and fill the mold. A superplasticizing agent is not required but is preferred. Without the superplasticizer, more water must be added to the slurry to infiltrate the mat. Superplasticizing agents are known and have been used in flowing concrete and water-reduced, high strength concrete. See for example "Superplasticized Concrete", ACI Journal, May, 1988, pp. N6N11 and "Flowing Concrete, Concrete Constr., Jan., 1979 (pp 25–27). The most common superplasticizers are sulfonated melamine formaldehyde and sulfonated naphthalene formaldehyde. The superplasticizers used in the present invention are those which enable the aqueous cementitious slurry to fully infiltrate the packed fibers. Of those plasticizers that are commercially available, Mighty 150, a sulfonated naphthalene formaldehyde available from ICI is preferred.

The molding means is typically manufactured from a heavy plastic sheet material which has sufficient thickness and strength to resist rupture when evacuated. Examples of such plastic materials include polyolefins such as polyethylene, polypropylene and the like, polyvinyl chloride, cellulose acetate, polyester urethane, silicon rubber, polyurethanes, etc. These sheets may range from about 0.001 to 0.01 inch thick. The effect of the sharp, pointed metal fibers of the mat can be minimized by compressing the mat or otherwise smoothing its surface to eliminate or reduce the number of fiber ends which may puncture or tear the mold material. A liner may also be used to separate the vacuum bag from the fibers to provide a smoother surface and prevent punctures.

The efficiency in which the cementitious material spreads throughout the mold cavity and penetrates into the interstitial voids of the fibrous reinforcing mat is dependent upon the composition of the cementitious material, the vacuum or pressure applied to the mold and, to a degree, the area of the mold cavity to be infiltrated. The cementitious material, of course, must remain fluid for a time sufficient to allow the mold cavity and the fibrous mat to fill completely.

In accordance with the embodiment of the invention wherein the shell segments of the columns are precast at the factory for transfer to the job site prior to forming the column, it is to be understood that while it may be convenient to prepare the fiber reinforced shell segments using the fiber mats described above, those skilled in the art will recognize that individual metal fibers of any convenient length, diameter and aspect ratio may be employed in place of the preformed mats to form the metal reinforcement in situ for the shell by simply placing the individual fibers in the shell mold and impregnating the fibers with a cementitious material. In general, these metal fibers may have diameters in the range of about 0.010 to 0.050 inch and have lengths in the range of about 0.75 to 3.0 inch. The metal fibers preferably also have a controlled ratio of length to diameter of at least about 50; this ratio in the art being referred to as the aspect ratio. Using the discrete fibers, the shell may contain at least 2 volume percent, preferably at least 4 volume percent and still more preferably 8 to 16 volume percent of the metal fibers.

Having described the invention in detail and by reference to preferred embodiments thereof, it will be apparent that modifications and variations may be made without departing from the scope of the invention.

What is claimed is:

1. A method for manufacturing a reinforced cementitious columnar structure comprising:

providing a mold having a cavity which corresponds to a shape and size of said columnar structure;

placing at least one nonwoven metal fiber mat into said cavity around a periphery thereof so as to form a core volume internally of said mat;

introducing a slurry of cementitious material containing a predetermined amount of aggregate having a particle size greater than a size of interstitial voids of said fiber mat into said core volume, said aggregate and said cementitious material filling said core volume and said cementitious material infiltrating and encapsulating said fiber mat, and said aggregate remaining within said core volume;

curing said slurry of cementitious material to form said reinforced cementitious columnar structure; and separating said mold from said reinforced cementitious columnar structure.

2. The method of claim 1 wherein said nonwoven metal fiber mat comprises metal fibers of stainless steel, carbon steel or manganese steel.

3. The method of claim 2 wherein said metal fibers are present in said mat in an amount of about 2 to 10% by volume.

4. The method of claim 1 wherein said cementitious material is a hydraulic cement or a polymer cement.

5. The method of claim 4 wherein said cementitious material comprises a dispersing agent to facilitate permeation of said cementitious material throughout said interstitial voids of said metal fiber mat.

6. The method of claim 5 wherein said dispersing agent is a superplasticizing agent selected from the group consisting of sulfonated melamine formaldehyde and sulfonated naphthalene formaldehyde.

* * * * *